US011211749B2

(12) United States Patent
Cave et al.

(10) Patent No.: US 11,211,749 B2
(45) Date of Patent: Dec. 28, 2021

(54) PLUG RETAINER APPARATUS AND RELATED METHODS

(71) Applicant: The Nielsen Company (US), LLC, New York, NY (US)

(72) Inventors: Mark Richard Cave, Palm Harbor, FL (US); Michael Alan Hicks, Clearwater, FL (US)

(73) Assignee: THE NIELSEN COMPANY (US), LLC, New York, NY (US)

( * ) Notice: Subject to any disclaimer, the term of this patent is extended or adjusted under 35 U.S.C. 154(b) by 423 days.

(21) Appl. No.: 15/668,509

(22) Filed: Aug. 3, 2017

(65) Prior Publication Data

US 2019/0044283 A1 Feb. 7, 2019

(51) Int. Cl.

| | |
|---|---|
| ***H01R 13/62*** | (2006.01) |
| ***H01R 13/639*** | (2006.01) |
| ***H01R 13/73*** | (2006.01) |
| ***H01R 13/58*** | (2006.01) |
| *H01R 24/30* | (2011.01) |

(52) U.S. Cl.

CPC ..... *H01R 13/6395* (2013.01); *H01R 13/5841* (2013.01); *H01R 13/73* (2013.01); *H01R 24/30* (2013.01)

(58) Field of Classification Search

CPC ... H01R 13/639; H01R 13/6395; H01R 13/73
USPC ..... 439/368, 369, 370, 371, 372, 373
See application file for complete search history.

(56) References Cited

U.S. PATENT DOCUMENTS 2,266,560 A * 12/1941 Mansfield ..... H01R 13/6395 439/368
2,290,175 A * 7/1942 Gade ..... F16B 39/286 411/277
2,299,085 A * 10/1942 Gade ..... F16B 39/286 411/277
2,410,995 A * 11/1946 Olson, Jr. ..... F16B 37/02 411/277
2,424,604 A * 7/1947 Dzus ..... F16B 39/36 411/278
2,569,037 A * 9/1951 Dalton ..... H01R 13/6395 439/345
3,005,176 A * 10/1961 Berg ..... H01R 13/6395 439/369
3,687,182 A * 8/1972 Grimm ..... F16B 39/284 411/280
3,702,628 A * 11/1972 Cosenza ..... F16B 39/36 411/280
4,018,132 A * 4/1977 Abe ..... F16B 5/0275 411/413
4,046,451 A * 9/1977 Juds ..... H01R 24/564 174/75 C (Continued)

*Primary Examiner* — Harshad C Patel
(74) *Attorney, Agent, or Firm* — Hanley, Flight & Zimmerman, LLC

(57) ABSTRACT

Example retainer apparatus and related methods are disclosed. An example retainer apparatus disclosed herein includes a post having a first end attachable to a wall plate cover opening of an outlet and a second end opposite the first end. The example retainer apparatus also includes a plug retainer to be removably coupled to the post. The plug retainer of the example retainer apparatus is to move relative to the post between the first end of the post and the second end of the post.

29 Claims, 11 Drawing Sheets

(56) References Cited

U.S. PATENT DOCUMENTS 4,236,561 A * 12/1980 Monticelli ..... F16B 39/284 411/280
4,424,407 A * 1/1984 Barbic ..... H01R 13/447 174/67
4,618,200 A * 10/1986 Roberts ..... H01R 13/6395 439/147
4,652,069 A 3/1987 Smith
4,789,353 A * 12/1988 Busta ..... H01R 13/6395 439/373
4,990,043 A * 2/1991 Hafeli ..... F16B 39/284 411/280
5,011,427 A 4/1991 Martin
5,044,976 A 9/1991 Thompson
5,087,796 A * 2/1992 Norman ..... H02G 3/14 174/67
5,088,868 A * 2/1992 Cosenza ..... F16B 39/36 411/280
5,127,782 A * 7/1992 McCorkle ..... F16B 39/284 411/266
5,434,745 A * 7/1995 Shokrgozar ..... H01L 25/0657 174/538
5,702,217 A * 12/1997 Charbonnel ..... F16B 1/0014 411/259
5,766,037 A * 6/1998 Nelson ..... H01R 24/564 439/583
6,337,611 B1 * 1/2002 Hult ..... H01P 1/205 333/202
6,491,539 B1 12/2002 Johnston
6,607,398 B2 * 8/2003 Henningsen ..... H01R 24/564 439/578
6,808,348 B1 * 10/2004 Cosenza ..... F16B 39/286 411/280
7,874,864 B2 * 1/2011 Luu ..... H01R 13/6395 439/373
8,047,870 B2 * 11/2011 Clausen ..... H01R 9/0524 439/578
8,298,006 B2 * 10/2012 Wild ..... H01R 13/17 439/447
8,956,177 B2 2/2015 Warner
2009/0280674 A1 * 11/2009 Eppright ..... H01R 13/6395 439/373

* cited by examiner

PLUG RETAINER APPARATUS AND RELATED METHODS

FIELD OF DISCLOSURE

This patent is directed to plug retainers and, more specifically, to plug retainer apparatus and related methods.

BACKGROUND

Audience measurement entities (AMEs) and the like monitor user interaction with media devices, such as smartphones, tablets, laptops, smart televisions, etc. To facilitate such monitoring, AMEs enlist panelists and install meters at the media presentation locations of those panelists. The meters monitor media presentations and transmit media monitoring information to a central facility of the AME. However, removing power (e.g., electrical power) to the metering device may inhibit accurate collection of the media monitoring information and/or impede monitoring efforts of the AME.

Figure 1:
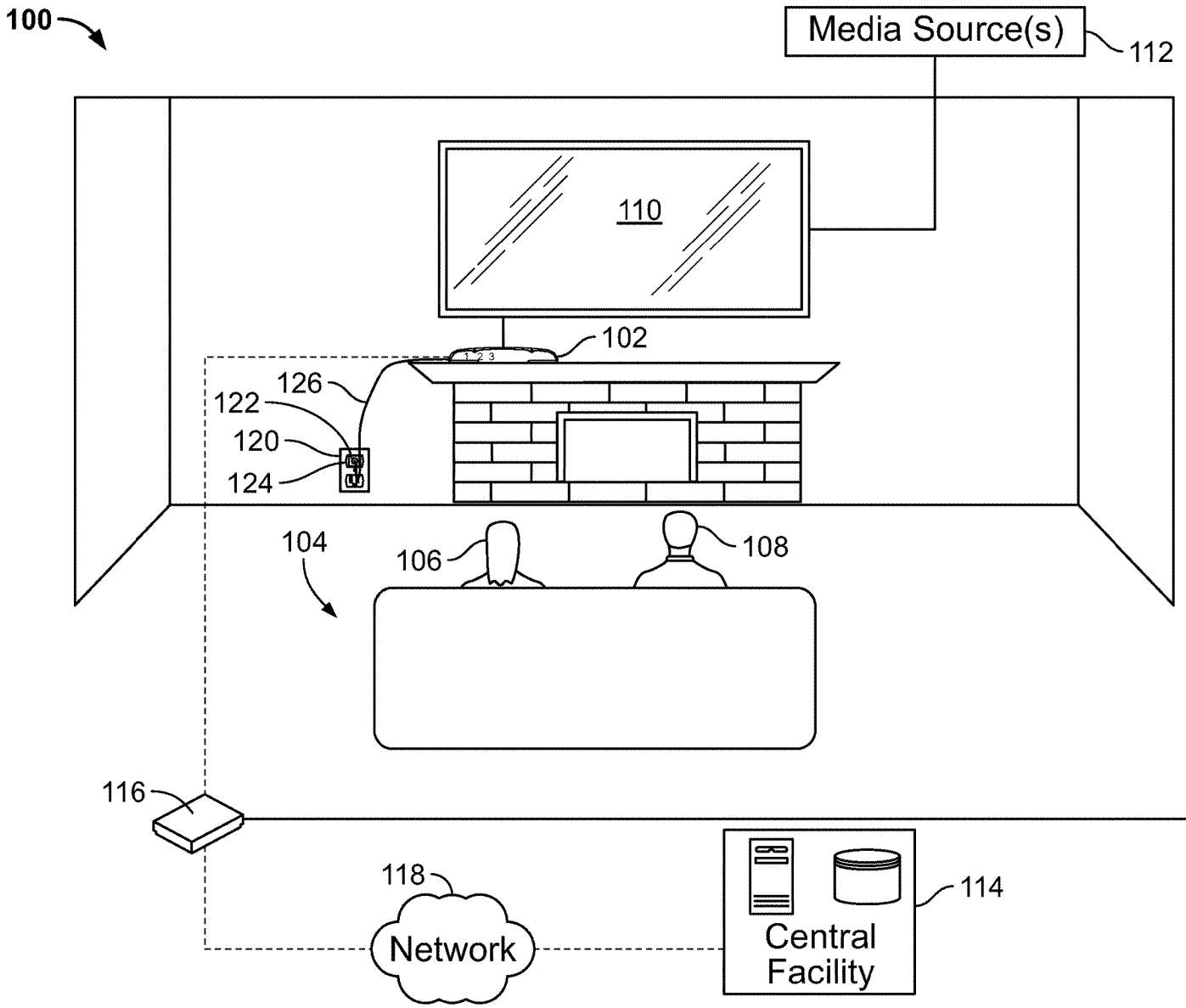
FIG. 1 illustrates an example audience measurement system having an example meter to monitor at a media presentation environment.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts. Stating that a part is coupled or connected to another part indicates that the parts are jointed directly or through one or more intervening parts. Thus, physical contact is not required for two parts to be coupled or connected.

DETAILED DESCRIPTION

Example retainer apparatus and related methods disclosed herein provide a plug lock for securing or holding power cords or plugs (e.g., an alternating current (AC) electrical plug) to an outlet (e.g., an alternating current (AC) electrical outlet) to avoid inadvertent removal and/or deter removal of the power plug from the electrical outlet. As used herein, the term "plug" refers to any plug, power plug, electric plug, plug top and the like, and such terms are used interchangeably. As used herein, the term "outlet" refers to any outlet, power outlet, wall outlet, power point, plug socket, wall socket, socket-outlet, electrical outlet, electrical receptacle and the like, and such terms are used interchangeably.

Although example retainer apparatus disclosed herein secure a plug to an outlet and/or deter removal of the plug from the outlet, example retainer apparatus disclosed herein enable quick release or removal of the plug from the outlet (e.g., during an emergency) without use of a tool (e.g., a screw driver, a cutter, etc.). In other words, a user may attach and/or remove an example retainer apparatus disclosed herein to retain and/or remove a plug from an outlet using only his/her hands. Furthermore, example retainer apparatus disclosed herein are adjustable (e.g., without use of a tool) to accommodate differently sized and/or shaped power cords (e.g., electrical power cords) and/or plugs.

Although example retainer apparatus disclosed herein include quick release capabilities to enable rapid removal of a plug from an outlet, example retainer apparatus disclosed herein impede, inhibit or deter removal of the plug from the outlet (e.g., during, for example, a non-emergency event). For example, a greater amount of force is needed to remove example retainer apparatus disclosed herein than is otherwise needed to remove the plug from the outlet. In some such examples, retainer apparatus disclosed herein prevent the power cord or plug from dislodging from the outlet and/or deter removal of the power cord or plug from an outlet to accommodate a plug of another electronic device.

Additionally, example retainer apparatus disclosed herein may be adapted to an existing outlet without risking damage to the outlet cover. For example, unlike some known plug retainers that wedge underneath or behind a wall plate of an outlet to retain the power cord to the outlet, example retainer apparatus disclosed herein fasten to a frame (e.g., a metal outlet box) of the outlet. More specifically, example retainer apparatus disclosed herein fasten (e.g., couple) to a standard wall plate cover of an electrical outlet via a wall plate cover screw opening of the wall plate cover. For example, example retainer apparatus disclosed herein fasten the wall plate cover to the outlet in place of a wall plate screw. Thus, unlike the known plug retainers that wedge behind the wall plate cover, which are likely to cause the wall plate to become damaged (e.g., break) if the power cord is inadvertently pulled from the outlet, example retainer apparatus disclosed herein prevent damage to the wall plate cover if the power cord is pulled (e.g., inadvertently) from a socket of the outlet.

Example retainer apparatus disclosed herein include an assembly having an example ratcheted post that interacts with example flexible tabs of an example plug retainer to enable the plug retainer to move along the ratcheted post and relative to a power plug positioned in an outlet. In some such examples, as an example plug retainer disclosed herein moves along the ratcheted post, the flexible tabs disclosed herein engage or cooperate the ratcheted post to secure the example plug retainer in a position that causes a support or arm of the plug retainer to contact a plug inserted into the outlet to prevent removal of the plug from the electrical outlet.

Figure 9:
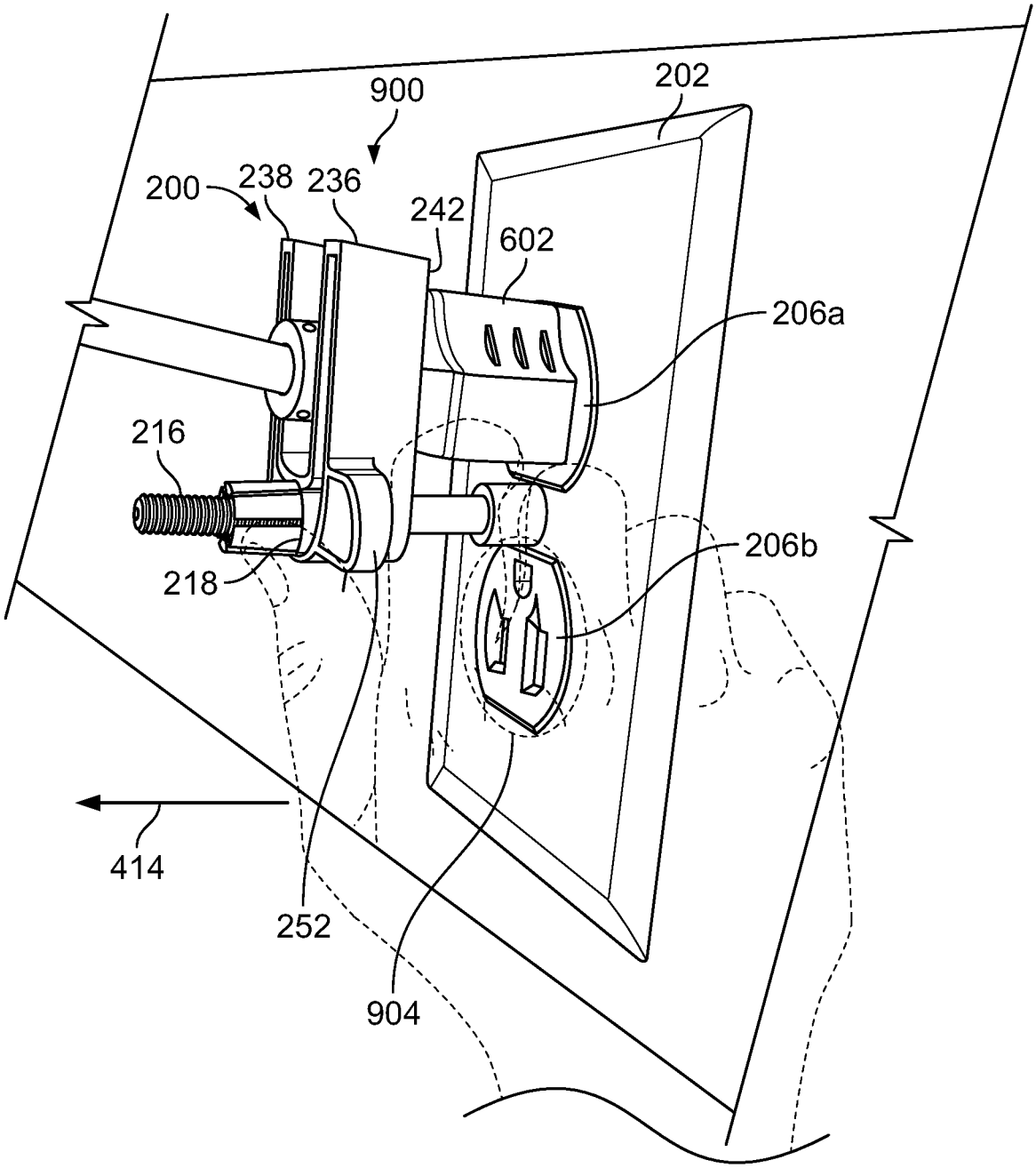
FIG. 9 is a perspective view of the example retainer apparatus of FIGS. 1-5 in a retaining position.
Figure 10:
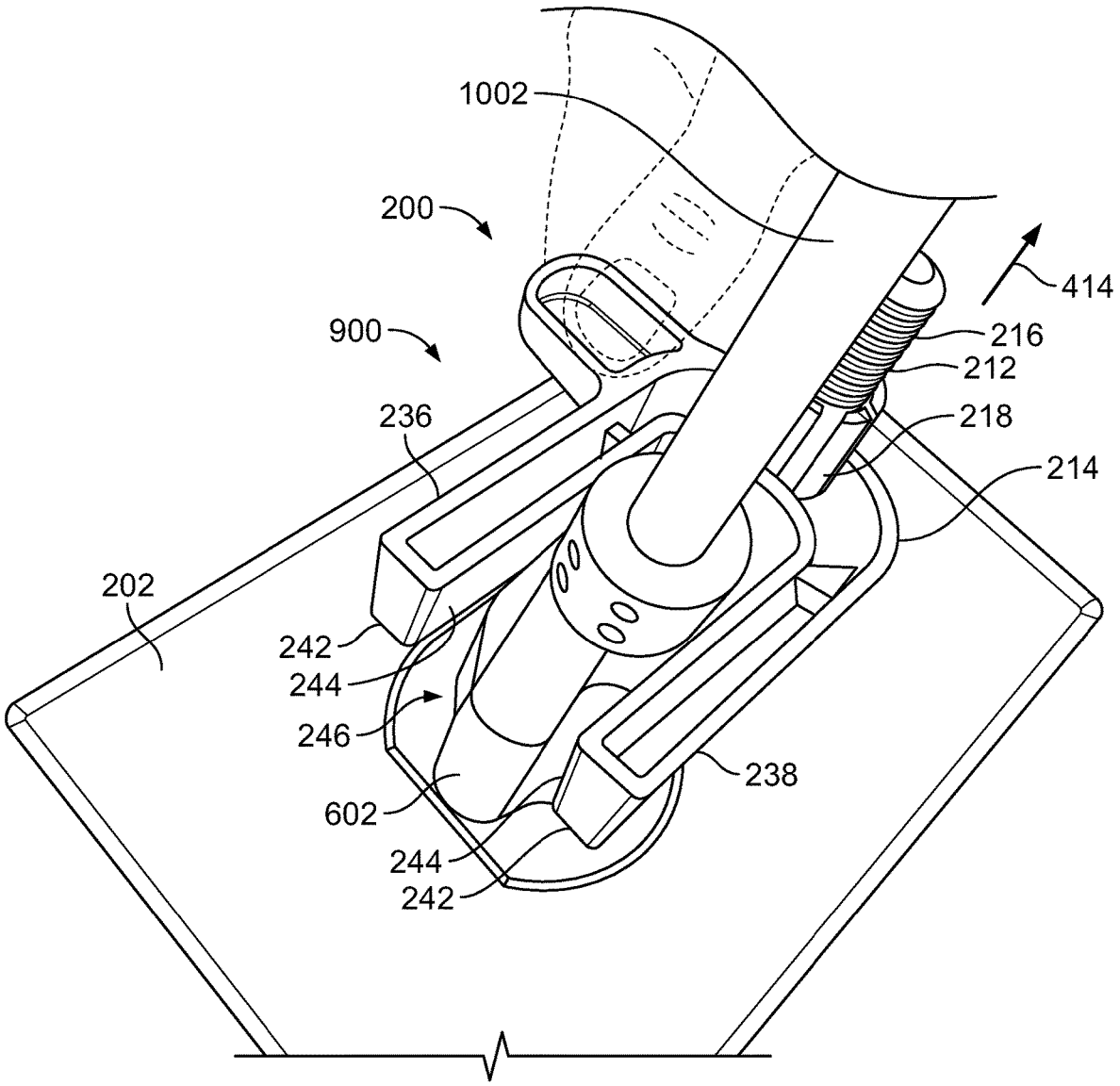
FIG. 10 is another perspective view of the example retainer apparatus of FIGS. 1-5 in the retaining position.
Figure 11:
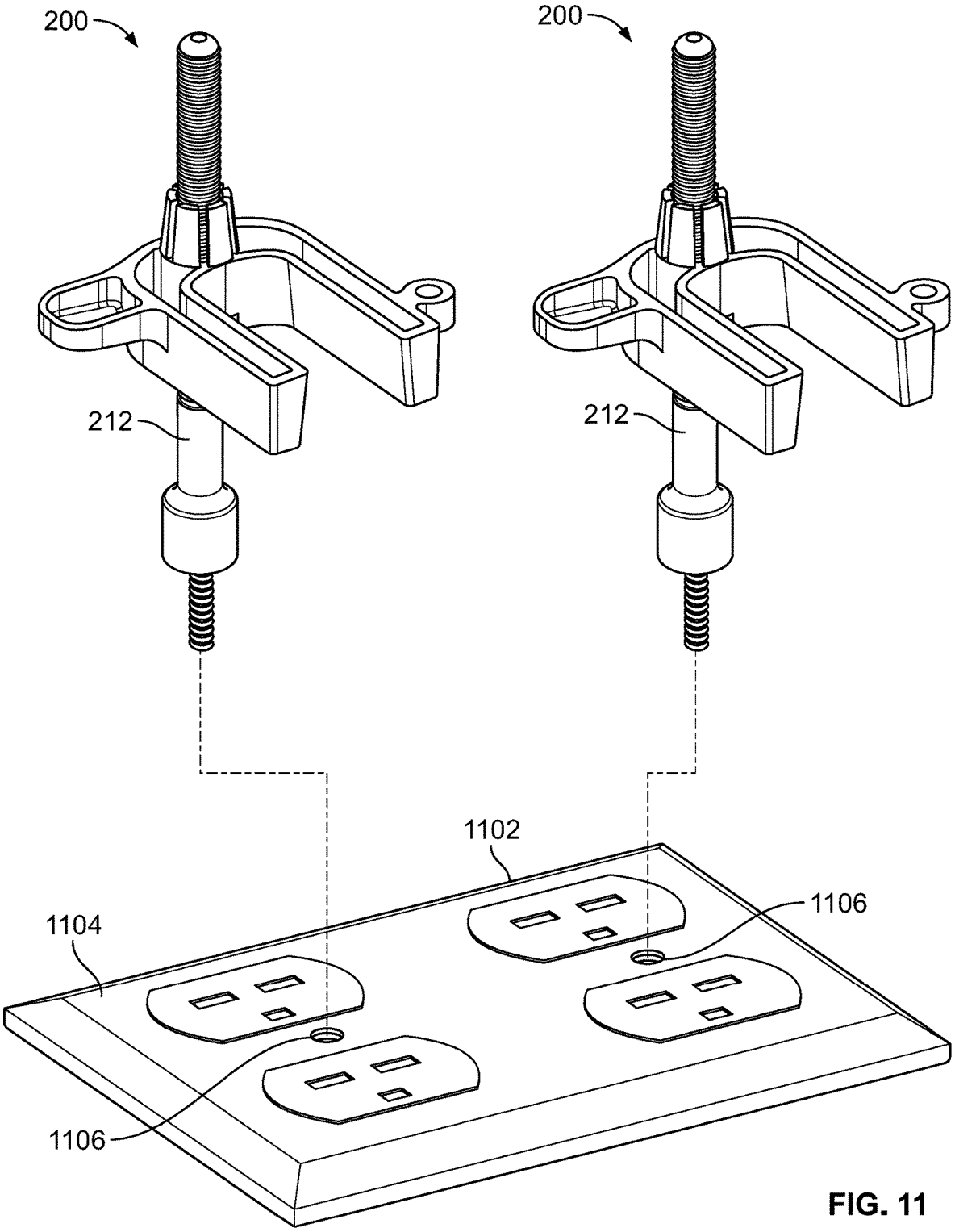
FIG. 11 is a perspective view of a plurality of example retainer apparatus disclosed herein coupled to another example electrical outlet.

Example retainer apparatus disclosed herein may be used with outlets supporting a single cover plate screw as shown, for example, in FIGS. 2-10 or outlets supporting two or more cover plate screws positioned at either end of a cover plate as shown, for example, in FIG. 11. Example retainer apparatus disclosed herein may be used to retain a power plug of any electronic device such as, for example, a metering device, a television, a computer, a server, a coffee maker, and/or any other electronic appliance(s) and/or electronic device(s). In some examples, example retainer apparatus disclosed herein may be used to childproof electrical plugs that couple to standard electrical sockets or outlets.

FIG. 1 is an illustration of an example audience measurement system 100. Audience measurement systems often rely on statistically derived panelist that provide quality data to the ratings measurement. Audience measurement entities (also referred to herein as "AMEs," "ratings entities," or "monitoring companies," etc.) determine demographic reach for advertising and media programming based on registered panel members. That is, an audience measurement entity enrolls people that consent to being monitored into a panel. During enrollment, the audience measurement entity receives demographic information from the enrolling people so that subsequent correlations may be made between advertisement/media exposure to those panelists and different demographic markets. For example, monitoring companies desire knowledge on how users interact with media devices, such as smartphones, tablets, laptops, smart televisions, etc. In particular, media monitoring companies monitor media presentations made at the media devices to, among other things, monitor exposure to advertisements, determine advertisement effectiveness, determine user behavior, identify purchasing behavior associated with various demographics, etc. As used herein, the term "media" includes any type of content and/or advertisement delivered via any type of distribution medium. Thus, media includes television programming or advertisements, radio programming or advertisements, movies, web sites, streaming media, etc.

In the illustrated example of FIG. 1, the audience measurement system 100 of the illustrated example includes an example meter 102 to monitor an example media presentation environment 104. The media presentation environment 104 of the illustrated example includes a panelist 106, a household member 108, an example media device 110 that receives media from an example media source 112, and the meter 102. For example, a panelist home is metered with devices such as, for example, the meter 102 that identifies the media presented by the media device 110 and reports media monitoring information to an example central facility 114 of an audience measurement entity via an example gateway 116 and an example network 118. The meter 102 of FIG. 1 sends media identification data and/or audience identification data to the central facility 114 periodically, a-periodically and/or upon request by the central facility 114.

In the illustrated example of FIG. 1, the media presentation environment 104 is a room of a household (e.g., a room in a home of a panelist, such as the home of a "Nielsen family") that has been statistically selected to develop media (e.g., television) ratings data for a population/demographic of interest. In the illustrated example of FIG. 1, the example panelist 106 of the household has been statistically selected to develop media ratings data (e.g., television ratings data) for a population/demographic of interest.

The meter 102 of the illustrated example detects exposure to media and electronically stores monitoring information (e.g., a code detected with the presented media, a signature of the presented media, an identifier of a panelist present at the time of the presentation, a timestamp of the time of the presentation) of the presented media. The stored monitoring information is then transmitted back to the central facility 114 via the gateway 116 and the network 118. While the media monitoring information is transmitted by electronic transmission in the illustrated example of FIG. 1, the media monitoring information may additionally or alternatively be transferred in any other manner, such as, for example, by physically mailing the meter 102, by physically mailing a memory of the meter 102, etc. The central facility 114 processes and stores data received from the meter 102. For example, the central facility 114 of FIG. 1 combines audience identification data and program identification data from multiple households to generate aggregated media monitoring information. The central facility 114 generates reports for advertisers, program producers and/or other interested parties based on the compiled statistical data. Such reports include extrapolations about the size and demographic composition of audiences of content, channels and/or advertisements based on the demographics and behavior of the monitored panelists.

In examples disclosed herein, an audience measurement entity provides the meter 102 to the panelist 106 (or household of panelists) such that the meter 102 may be installed by the panelist 106 by simply powering the meter 102 and placing the meter 102 in the media presentation environment 104 and/or near the media device 110 (e.g., near a television set). In some examples, more complex installation activities may be performed by the panelist 106 and/or a field technician, such as, for example, electronically connecting the meter 102 to the media device 110, etc.

The meter 102 of the illustrated example requires power from an outlet or an example dual electrical outlet 120 (e.g., an AC power outlet) of the home. However, in some instances, the panelist 106, the household member 108 and/or a guest may require use an outlet of the dual electrical outlet 120. For example, the panelist 106, the household member 108 and/or a guest may remove a plug 122 (e.g., an alternating current (AC) plug) of the meter 102 from an outlet 124 of the dual electrical outlet 120 to use the outlet 124 for powering another electronic device(s). For example, the plug 122 of the meter 102 may be removed from the outlet 124 to enable a charger to be plugged into the outlet 124 to charge a battery of a mobile device. In doing so, the panelist 106 may interrupt power to the meter 102. Interrupting power to the meter 102 may impact the collection of data, which in turn may impact a quality of the measurement report. In some examples, the plug 122 of the meter 102 may be inadvertently removed by the panelist 106, the household member 108 and/or a guest tripping over a power cord 126 of the meter 102.

Figure 2:
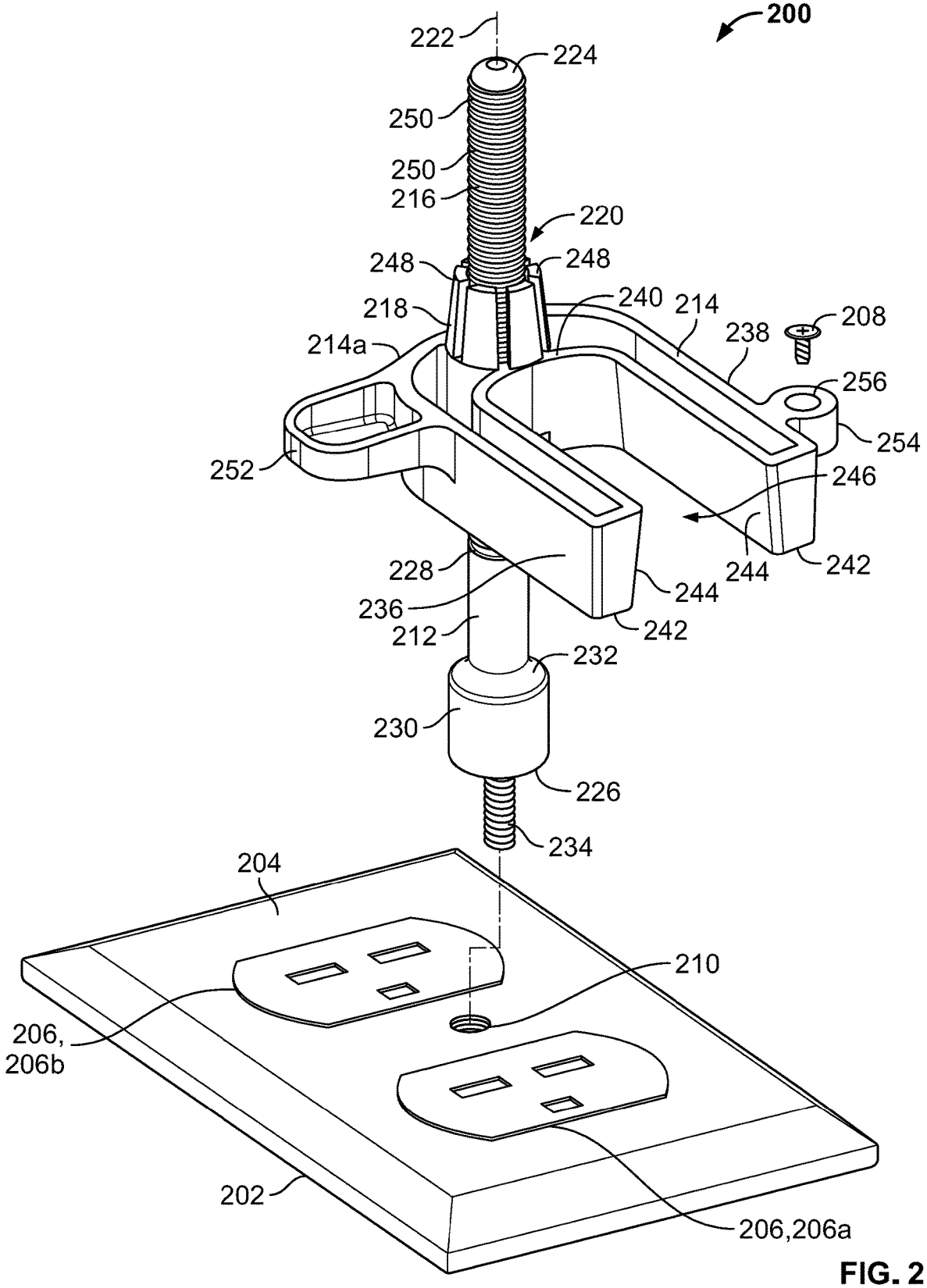
FIG. 2 illustrates an example plug retainer apparatus constructed in accordance with the teachings of this disclosure that may be employed with the meter of the audience measurement system of FIG. 1.

FIG. 2 is a perspective view of an example retainer apparatus 200 constructed in accordance with the teachings of this disclosure. The retainer apparatus 200 of the illustrated example provides a lock for securing a plug (e.g., an AC outlet plug) to an outlet 206 of a dual electrical outlet 202 (e.g., an AC electrical outlet) to avoid inadvertent removal of the plug from the outlet 206. In some examples, the retainer apparatus 200 of the illustrated example inhibits or deters removal of a plug from an electrical outlet. For example, the retainer apparatus 200 of the illustrated example may be employed with the meter 102 of FIG. 1. In some such examples, the retainer apparatus 200 of the illustrated example secures the plug 122 (FIG. 1) of the meter 102 (FIG. 1) to one of the outlets, such as the outlet 124, of the dual electrical outlet 120. The retainer apparatus 200 of the illustrated example reduces the likelihood that the meter 102 of FIG. 1 will be (e.g., inadvertently) powered-off by the panelist 106, the household member 108 and/or a guest.

The retainer apparatus 200 of the illustrated example may be employed with standard electrical outlets (e.g. AC electrical outlets) such as, for example, the dual electrical outlet 202 of FIG. 2 and/or the dual electrical outlet 120 of FIG. 1. The dual electrical outlet 202 of the illustrated example is mounted in an opening formed in a building wall and a wall plate cover 204 is typically secured over the opening of the building exposing the individual outlets 206 (e.g., sockets) of the dual electrical outlet 202. In the illustrated example, the dual electrical outlet 202 includes a first outlet **206*a* and a second outlet 206*b*. To receive a wall plate cover screw 208 to secure the wall plate cover 204 to the dual electrical outlet 202, the dual electrical outlet 202 of the illustrated example includes a wall plate cover screw opening 210 (e.g., a threaded mounting aperture). The wall plate cover screw opening 210 of the illustrated example is located (e.g., centrally positioned) between the first outlet 206*a* and the second outlet 206*b***.

Although the retainer apparatus 200 of the illustrated example couples to the dual electrical outlet 202 to retain a first power plug of a first electronic device positioned in the first outlet **206*a*, the retainer apparatus 200 does not interfere with a second power plug of a second electronic device positioned in the second outlet 206*b* when the retainer apparatus 200 retains or secures the first power plug in the first outlet 206*a*. Thus, in some such examples, the second power cord may be coupled to and/or removed from the second outlet 206*b* while the retainer apparatus 200 of the illustrated example is coupled to the dual electrical outlet 202 to retain the first power cord in the first outlet 206*a***.

To retain and/or remove a power plug of an electronic device to and/or from the dual electrical outlet 202, the retainer apparatus 200 of the illustrated example includes an example post 212 and an example plug retainer 214. In the illustrated example, the plug retainer 214 removably couples to the post 212. To removably couple the plug retainer 214 and the post 212, the post 212 of the illustrated example includes a retainer-receiving portion 216 and the plug retainer 214 of the illustrated example includes a post-receiving portion 218. In the illustrated example, the retainer-receiving portion 216 is configured to slidably receive the post-receiving portion 218. Thus, the retainer-receiving portion 216 and the post-receiving portion 218 of the illustrated example enable the plug retainer 214 to move (e.g., slide) relative to the post 212 along a longitudinal axis 222 of the post 212. Additionally, to secure or lock a position of the plug retainer 214 relative to the post 212, the post 212 and the plug retainer 214 include a lock 220. As described in greater detail below, the retainer-receiving portion 216 and the post-receiving portion 218 of the illustrated example cooperate to provide the lock 220.

The retainer-receiving portion 216 of the illustrated example is positioned between a first end 224 of the post 212 and a second end 226 of the post 212 opposite the first end 224. In particular, the retainer-receiving portion 216 of the illustrated example is positioned between an intermediate portion 228 of the post 212 and the first end 224 of the post 212. The retainer-receiving portion 216 and/or the post 212 of the illustrated example is a cylindrical body. However, the retainer-receiving portion and/or the post 212 may have any other shape or profile (e.g., a square or other geometric shape(s) or profile(s)).

To couple the post 212 to the dual electrical outlet 202, the post 212 of the illustrated example includes a post-attaching portion 230. The post-attaching portion 230 of the illustrated example (e.g., a base 232 of the post 212) is positioned adjacent the second end 226 of the post 212. The post-attaching portion 230 of the illustrated example includes a fastener 234. The fastener 234 of the illustrated example extends or protrudes from the second end 226 (e.g., the base 232) of the post 212. The fastener 234 of the illustrated example couples the post 212 to the wall plate cover 204. More specifically, the fastener 234 of the illustrated example is sized to fasten to the wall plate cover screw opening 210 (e.g., the mounting bore) that receives the wall plate cover screw 208. For example, the fastener 234 of the illustrated example is a one-half inch, Unified Thread Standard (UTS) diameter/thread size #6-32 threaded screw or rod. Thus, the post 212 of the illustrated example couples to (e.g., is received by) the wall plate cover screw opening 210 of the dual electrical outlet 202 that receives the wall plate cover screw 208.

The plug retainer 214 of the illustrated example defines a body **214*a* having a first arm 236 and a second arm 238 spaced from the first arm 236 and that protrude from a base 240 of the body 214*a*. The base 240, the first arm 236 and the second arm 238 of the illustrated example form or define a U-shaped profile or shape. The first arm 236 of the illustrated example is spaced from the second arm 238 to define a gap 246. In some examples, a power cord and/or at least a portion of the power plug passes through the gap 246 between the first arm 236 and the second arm 238 when the plug retainer 214 retains a power plug in the dual electrical outlet 202 (e.g., in the first outlet 206*a* of the dual electrical outlet 202). The first arm 236 and the second arm 238 define first plug engaging surfaces 242 to engage (e.g., directly contact or engage) a first portion of a power plug of an electric device and second plug engaging surfaces 244 to engage (e.g., directly contact or engage) a second portion of the power plug different from the first portion of the power plug. The first plug engaging surfaces 242 of the illustrated example are oriented substantially perpendicular relative to the second plug engaging surfaces 244. In particular, the second plug engaging surfaces 244 are oriented toward the gap 246 and the first plug engaging surfaces 242 are oriented away from the gap 246. Additionally, the first arm 236 and the second arm 238 of the plug retainer 214 do not overlap the second outlet 206*b* when retaining a power plug in the first outlet 206*a*. Thus, the retainer apparatus 200 disclosed herein does not interfere with a power plug coupled to the second outlet 206*b* when the retainer apparatus 200 is retaining a power plug in the first outlet 206*a*. In some examples, the plug retainer 214** may be formed with only arm one or may include more than two arms.

As noted above, to maintain or secure a position of the plug retainer 214 relative to the post 212, the retainer-receiving portion 216 of the post 212 and the post-receiving portion 218 of the plug retainer 214 of the illustrated example define the lock 220. The lock 220 of the illustrated example fixes or secures a position of the plug retainer 214 relative to the post 212. To provide the lock 220, the post-receiving portion 218 of the plug retainer 214 of the illustrated example includes a plurality of retaining tabs 248 (e.g., flexible fingers) and the retainer-receiving portion 216 of the post 212 of the illustrated example includes a plurality of grooves 250. To secure or lock a position of the plug retainer 214 relative to the post 212, the retaining tabs 248 interact with (e.g., engage) one (or more) of the grooves 250 of the post 212. Although the lock 220 secures the position of the plug retainer 214 relative to the post 212, the lock 220 of the illustrated example provides a quick release mechanism or means for removing the plug retainer 214 from the post 212, when needed, without use of a tool.

To facilitate a person grasping the plug retainer 214 and/or applying sufficient force to couple and/or remove the plug retainer 214 from the post 212, the plug retainer 214 of the illustrated example includes a grip 252 (e.g., a thumb tab). For example, a user may take hold of the grip 252 to move the plug retainer 214 relative to the post 212. Additionally, to hold or store the wall plate cover screw 208 that is removed from the dual electrical outlet 202 when the retainer apparatus 200 is coupled to the dual electrical outlet 202, the plug retainer 214 of the illustrated example includes a boss 254 (e.g., a threaded opening). Thus, while the retainer apparatus 200 is coupled to the dual electrical outlet 202, the wall plate cover screw 208 may be stored or positioned (e.g., coupled, threadably coupled, etc.) in an opening 256 defined by the boss 254. Employing the boss 254 to store the wall plate cover screw reduces the likelihood of losing the wall plate cover screw 208 that may otherwise be needed to couple the wall plate cover 204 to the dual electrical outlet 202 when the retainer apparatus 200 (e.g., the post 212) is removed from the dual electrical outlet 202.

Figure 3:
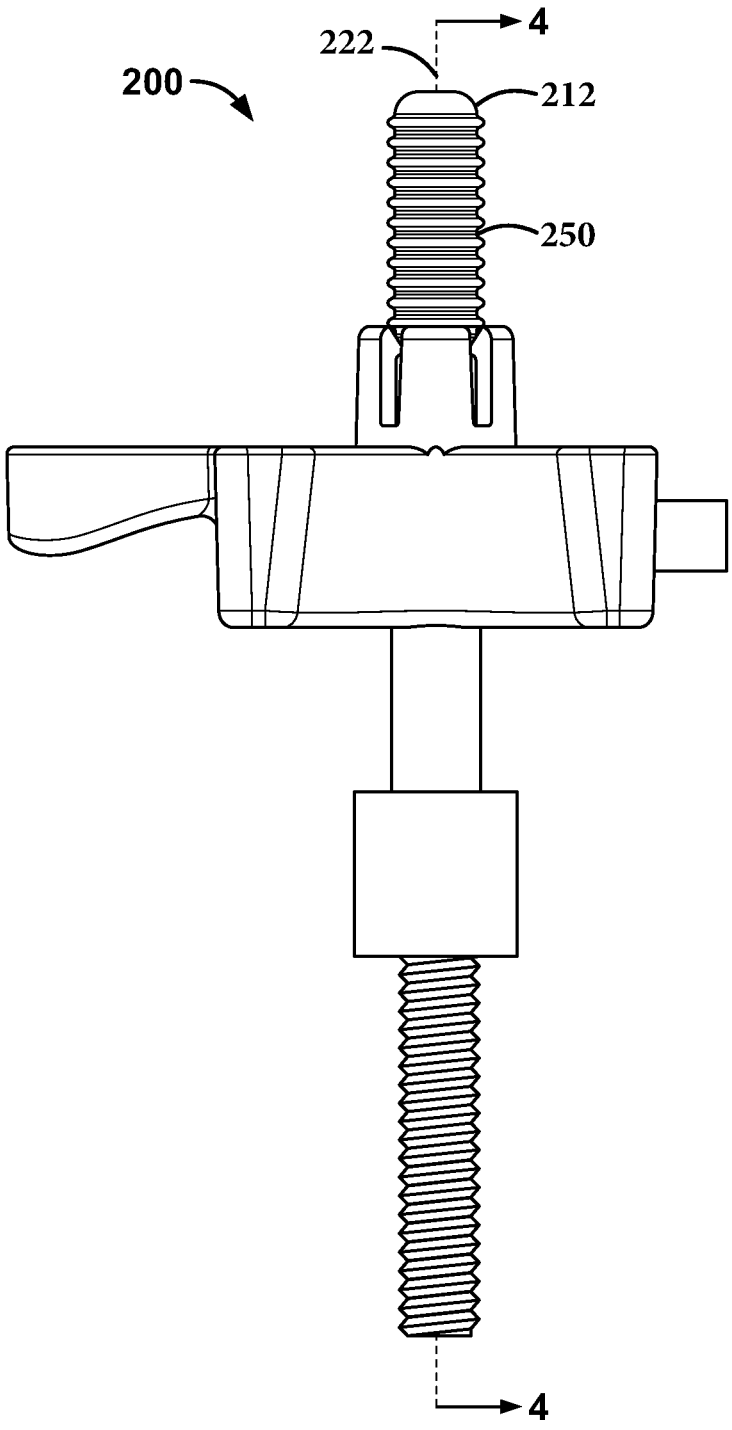
FIG. 3 illustrates a side view of the example retainer apparatus of FIG. 2.

FIG. 3 is a side view of the example retainer apparatus 200 of FIG. 3. Referring to FIG. 3, the grooves 250 of the post 212 are formed along the retainer-receiving portion 216 of the post 212. The grooves 250 are oriented orthogonally relative the longitudinal axis 222. In particular, the grooves 250 are spaced apart relative to each other such that the grooves 250 provide a plurality of isolated or spaced apart grooves. The grooves 250 provide a non-threaded retainer receiving portion 216. In other words, the retainer-receiving portion 216 includes a plurality of non-continuous or discrete grooves 250.

Figure 4:
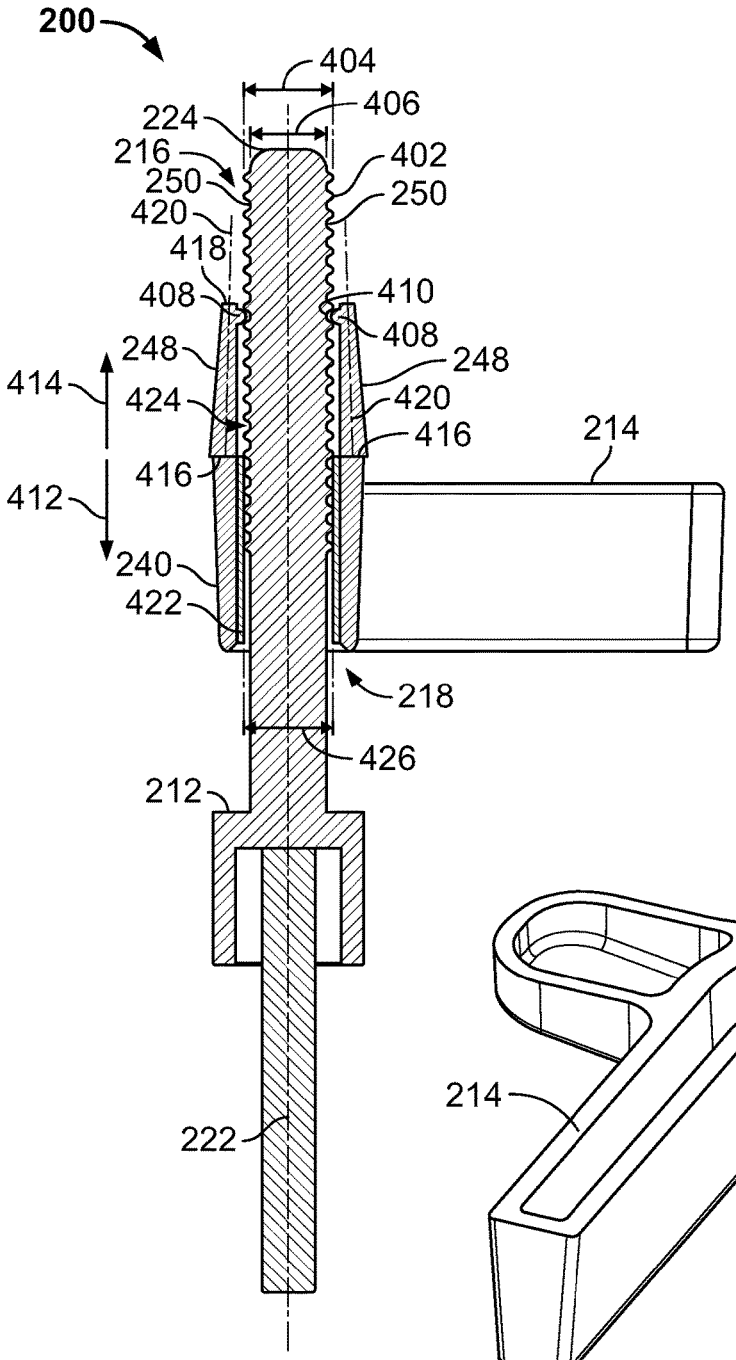
FIG. 4 is a cross-sectional view of the example retainer apparatus disclosed herein taken along line 4-4 of FIG. 3.

FIG. 4 is a cross-sectional view of the example retainer apparatus 200 taken along line 4-4 of FIG. 3. In particular, an outer surface 402 of the post 212 (e.g., an outermost surface of the retainer-receiving portion 216) defines a first outer diameter 404 of the retainer-receiving portion 216 and the grooves 250 provide a second outer diameter 406 of the retainer-receiving portion 216. In the illustrated example, the first outer diameter 404 is greater than the second outer diameter 406. The grooves 250 formed on the retainer-receiving portion 216 provide a non-threaded retainer-receiving portion of the post 212 defined by the plurality of discrete or spaced apart grooves 250 formed on the outer surface 402 of the post 212. As shown in FIG. 4, the plug retainer 214 is positioned or fixed relative to the post 212. More specifically, each of the retaining tabs 248 includes a nub or protrusion 408 that engages a respective groove 410 of the grooves 250 to retain or fix a position of the plug retainer 214 relative to post 212. For example, each protrusion 408 of the retaining tabs 248 is positioned within the respective groove 410 of the grooves 250 when a position of the plug retainer 214 is fixed relative to the post 212.

The retaining tabs 248 of the illustrated example protrude from the base 240 of the plug retainer 214 toward the first end 224 of the post 212 in a direction along the longitudinal axis 222 of the post 212. To provide a biasing force and/or to improve (e.g., increase) flexibility of the retaining tabs 248, the retaining tabs 248 of the illustrated example have a tapered profile between a first end 416 (e.g., adjacent the base 240) of the retaining tabs 248 and a second end 418 of the retaining tabs 248 opposite the first end 416. For example, the retaining tabs 248 of the illustrated example are tilted, angled or canted relative to (e.g., toward) the longitudinal axis 222 of the post 212. For example, longitudinal axes 420 of the respective retaining tabs 248 are non-parallel relative to the longitudinal axis 222 of the post 212 when the plug retainer 214 is in a fixed position relative to the post 212. In this manner, the retaining tabs 248 provide a biasing force (e.g., a spring force) toward the longitudinal axis 222 of the post 212 to help retain the protrusions 408 of the retaining tabs 248 positioned in the respective groove 410 when the plug retainer 214 is fixed relative to the post 212.

Additionally, the retaining tabs 248 can flex away from the longitudinally axis 222 when the plug retainer 214 moves along the retainer-receiving portion 216 of the post 212. For example, as the plug retainer 214 moves in a first direction 412 or a second direction 414 (e.g., in a rectilinear direction) along the longitudinal axis 222 of the post 212, the retaining tabs 248 move or flex radially inwardly and/or outwardly relative to the longitudinal axis 222 of the post 212 as the protrusions 408 move along a contoured surface defined by the grooves 250 and the outer surface 402 of the post 212. For example, when the protrusions 408 of the retaining tabs 248 engage the outer surface 402 of the post 212, (e.g., the second ends 418 of each of) the retaining tabs 248 flex (e.g., relative to the first end 416) in a direction radially outwardly relative to the longitudinal axis 222 of the post 212. For example, when the protrusions 408 of the retaining tabs 248 are positioned in a respective one of the grooves 250, (e.g., the second ends 418 of each of) the retaining tabs 248 project (e.g., relative to the first end 416) in a direction radially inwardly relative the longitudinal axis 222 of the post 212.

Although the retainer apparatus 200 of the illustrated example includes the retaining tabs 248 having a tapered profile, some example retainer apparatus disclosed herein may include retaining tabs having are relatively straight profile. In other words, in some such examples, the longitudinal axes 420 of the retaining tabs 248 may be substantially parallel relative to the longitudinal axis 222 of the post 212. In some examples, an inner surface of the retaining tabs 248 positioned toward the grooves 250 may be tapered, canted or tilted relative to the longitudinal axis 222 of the post 212.

Further, to facilitate coupling between the plug retainer 214 and the post 212, the retainer apparatus 200 of the illustrated example includes a bearing or bushing 422. The bushing 422 of the illustrated example is positioned in a post-receiving opening 424 of the post-receiving portion 218 of the plug retainer 214. For example, the post-receiving opening 424 of the illustrated example is defined by the retaining tabs 248 and the base 240 of the plug retainer 214. The bushing 422 of the illustrated example includes an inner diameter 426 that is substantially equal to (e.g., within 1%) the first outer diameter 404 of the outer surface 402 of the post 212. In some instances, the bushing 422 increases a resistance and/or friction between the plug retainer 214 and the post 212, which may require additional force to couple or decouple the plug retainer 214 relative to the post 212, albeit without requiring a special tool.

Although the plug retainer 214 and the post 212 of the illustrated example include the retaining tabs 248 and the grooves 250 to secure a position of the plug retainer 214 relative to the post 212, other example clamping mechanism(s) and/or fastener(s) may be employed to implement the lock 220 to secure a position of the plug retainer 214 relative to the post 212. In some examples, the post 212 may include a relatively smooth cylindrical body having apertures spaced along the retainer-receiving portion 216 configured to receive a locking pin having a shaft positionable through at least one of the plug retainer 214 or the post 212. The locking pin may include a grip (e.g., a shackle, a hand grip, a loop-shaped grip, a quick release pin, etc.) to enable a user to quickly remove the pin from the post during an emergency. For example, the locking pin prevents removal of the plug retainer 214 from the post 212.

Figure 5:
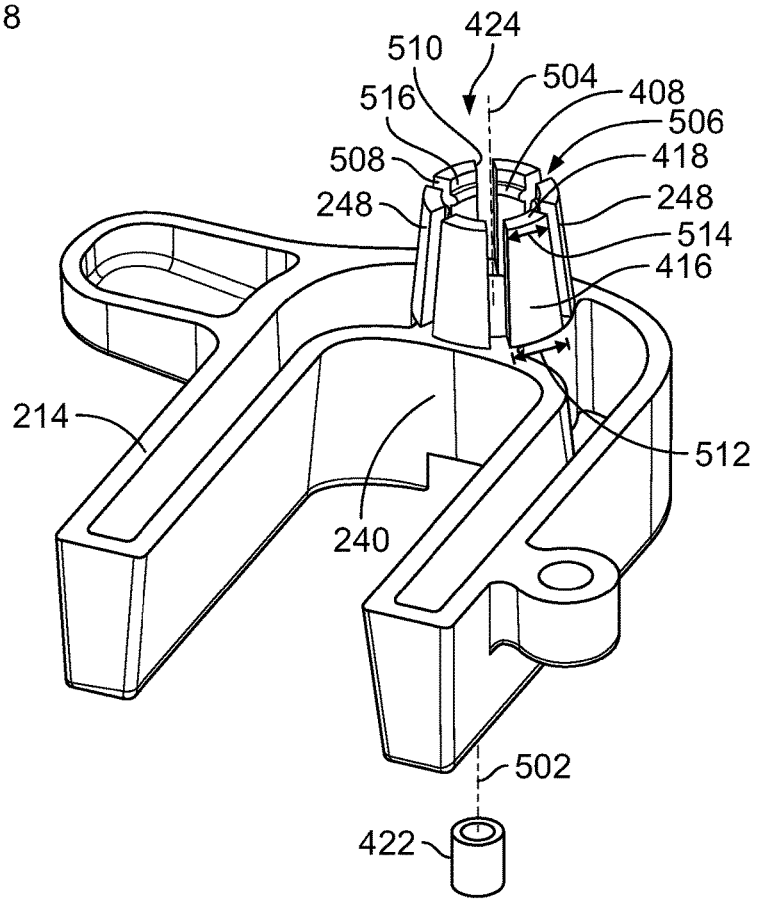
FIG. 5 is a partial exploded, perspective view of the example retainer apparatus of FIGS. 2-4.

FIG. 5 is an exploded view of the plug retainer 214 and the bushing 422 of the illustrated example of FIGS. 2-4. The bushing 422 of the illustrated example is positioned within the post-receiving opening 424 defined by the plug retainer 214. In the illustrated example, a longitudinal axis 502 of the bushing 422 coaxially aligns with a longitudinal axis 504 of the post-receiving opening 424 when the bushing 422 is positioned in the post-receiving opening 424.

The retaining tabs 248 of the illustrated example are spaced radially relative to the longitudinal axis 504 and/or the longitudinal axis 222 of the post 212. To enable the retaining tabs 248 to flex, bend and/or deflect relative to the longitudinal axis 222 of the post 212, each of the retaining tabs 248 are spaced such that a gap 506 is formed between a first side 508 and second side 510 of each of the retaining tabs 248. To improve (e.g., increase) flexibility of the retaining tabs 248, the retaining tabs 248 of the illustrated example include a dimensional characteristic (e.g., a dimensional width) that decreases in a direction between the first (e.g., inner) end 416 and the second (e.g., outer) end 418 of the retaining tabs 248. Thus, each of the retaining tabs 248 of the illustrated example includes a first dimensional characteristic 512 (e.g., a width) adjacent the first (e.g., inner) end 416 of the retaining tabs 248 that is greater than a second dimensional characteristic 514 (e.g., a width) adjacent the second (e.g., outer) end 418 of the retaining tabs 248. To facilitate engagement and/or disengagement with the grooves 250 of the post 212, the protrusions 408 of the retaining tabs 248 of the illustrated example include a contoured profile (e.g., a curved profile, a tapered profile, arcuate profile, a lead-in profile, etc.) as the protrusions 408 project from an inner surface 516 of the retaining tabs 248. Further, each of the protrusions 408 of the illustrated example extends between the first side 508 of the retaining tabs 248 and the second side 510 of the retaining tabs 248 opposite the first side 518.

The post 212, the plug retainer 214 and/or the bushing 422 of the illustrated example may be composed of plastic, metal, electrically resistive and/or insulating material(s), and/or any other material(s). The post, the plug retainer 214 and/or the bushing 422 may be formed via injection molding, machining, additive manufacturing (e.g., 3-D printing), a combination thereof, and/or any other manufacturing technique(s). Further, the fastener 234 of the example post 212 may be insert molded, overmolded with the post 212, and/or formed with the post 212 via 3-D printing, machining the second end 226 of the post 212, etc. In some examples, the fastener 234 is fastened to a threaded opening formed in the base 232 adjacent the second end 226 of the post 212, and/or may couple to, or be formed with, the post 212 using any other manufacturing technique(s).

Figure 6:
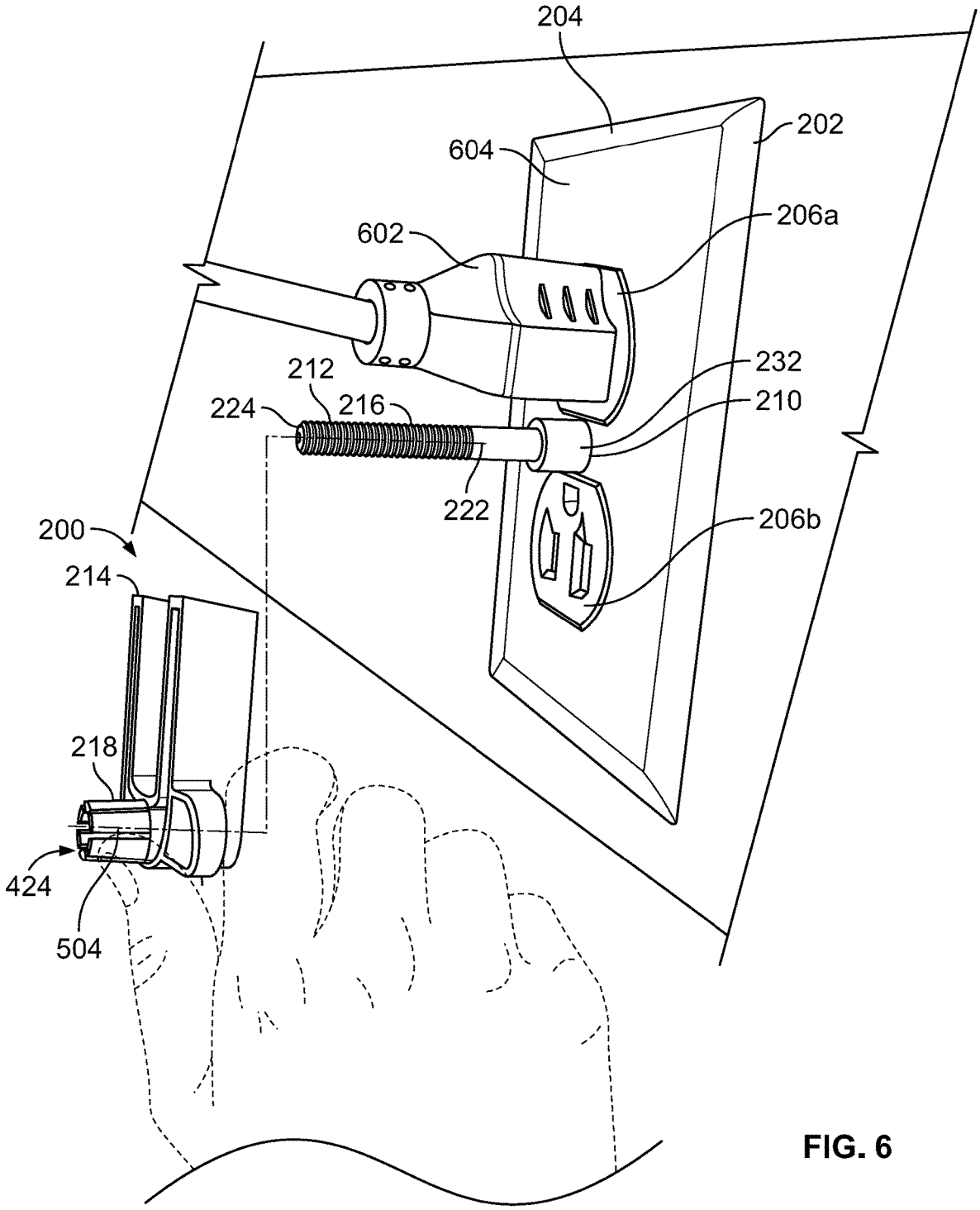
FIG. 6 is a perspective view of the example retainer apparatus of FIGS. 1-5 showing an example post of the example retainer apparatus coupled to an example electrical outlet and an example plug retainer of the example retainer apparatus decoupled from the example post.

FIGS. 6-9 illustrate employing the retainer apparatus 200 of the illustrated example to retain a power plug 602 (e.g., the electrical plug of the meter 102 of FIG. 1) of an electronic device to one of the outlets 206*a-b* of the dual electrical outlet 202. FIG. 6 illustrates the post 212 of the illustrated example coupled to the dual electrical outlet 202 and the plug retainer 214 detached from the post 212. To couple the post 212 to the dual electrical outlet 202, the wall plate cover screw 208 (FIG. 2) of the dual electrical outlet 202 is removed from the wall plate cover screw opening 210. The fastener 234 (FIG. 2) is coupled to (e.g., threadably coupled to) the wall plate cover 204 via the wall plate cover screw opening 210. In the illustrated example, when the post 212 is coupled to the dual electrical outlet 202, the base 232 (e.g., the second end 226) of the post 212 directly contacts or engages an outer surface 604 of the wall plate cover 204. When the post 212 is coupled to the dual electrical outlet 202, the post 212 is cantilevered from the wall plate cover 204 and/or the dual electrical outlet 202. Thus, the first end 224 or the retainer-receiving portion 216 of the post 212 projects from the dual electrical outlet 202 (e.g., the wall plate cover 204).

After the post 212 of the illustrated example is attached to the dual electrical outlet 202, the plug retainer 214 is coupled to the post 212. To couple the plug retainer 214 to the post 212, the post-receiving portion 218 of the plug retainer 214 is aligned with the retainer-receiving portion 216 of the post 212. More specifically, the longitudinal axis 504 of the post-receiving opening 424 is aligned with the longitudinal axis 222 of the post 212.

Figure 7:
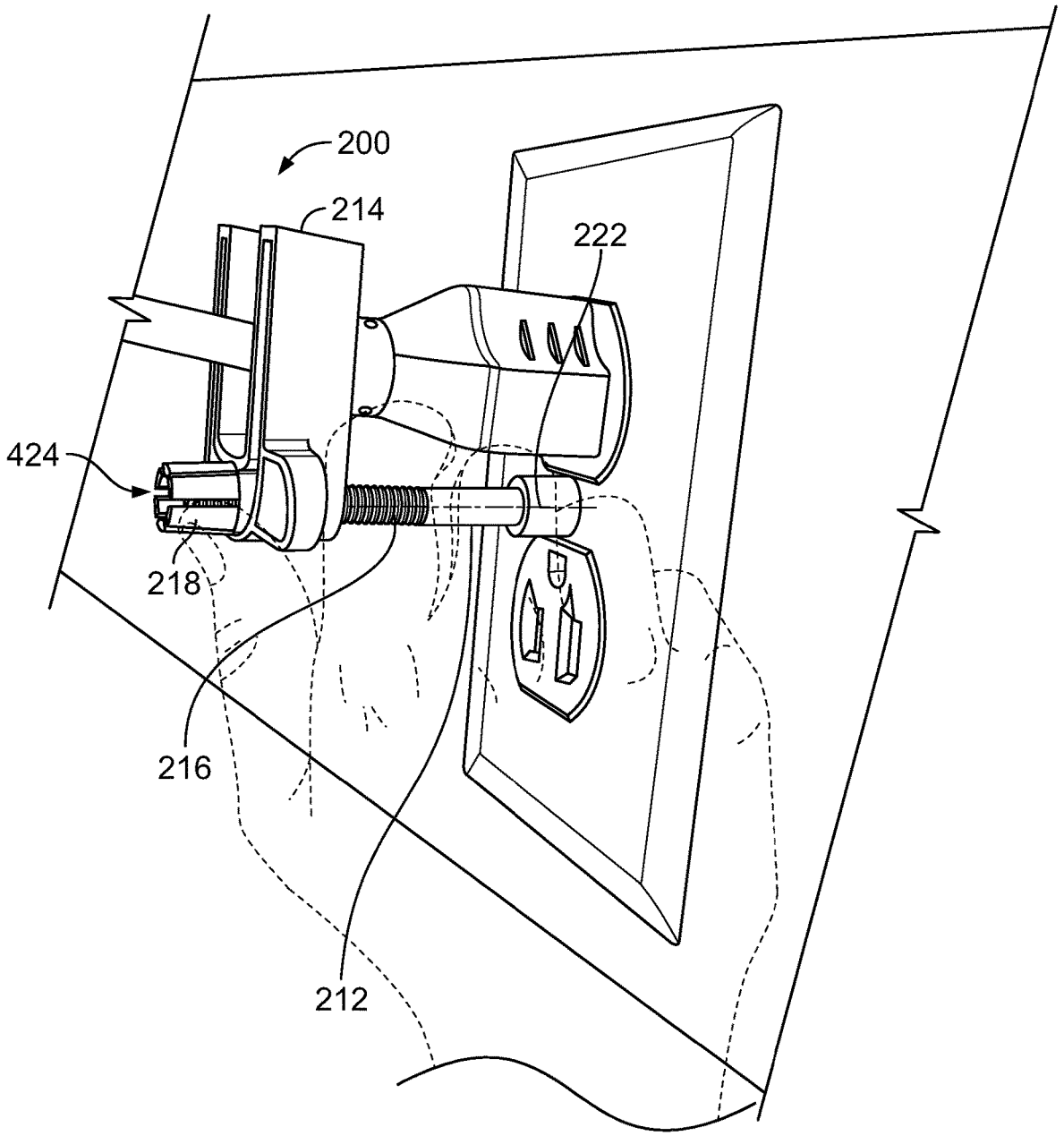
FIGS. 7 and 8 are perspective views of the example retainer apparatus of FIGS. 1-5 showing the example plug retainer of the example retainer apparatus coupled to the example post at various intermediate positions.

FIG. 7 illustrates the post 212 coupled to the dual electrical outlet 202 and the plug retainer 214 coupled to the post 212. Referring to FIG. 7, the retainer-receiving portion 216 of the post 212 receives the post-receiving portion 218 of the plug retainer 214. In other words, the post 212 inserts or couples to the post-receiving opening 424 of the plug retainer 214. The retainer-receiving portion 216 of the post 212 and the post-receiving portion 218 of the plug retainer 214 of the illustrated example allow the plug retainer 214 to move (e.g., slide) along the post 212 along the longitudinal axis 222 of the post 212 between the first end 224 of the post 212 and the intermediate portion 228 of the post 212.

Figure 8:
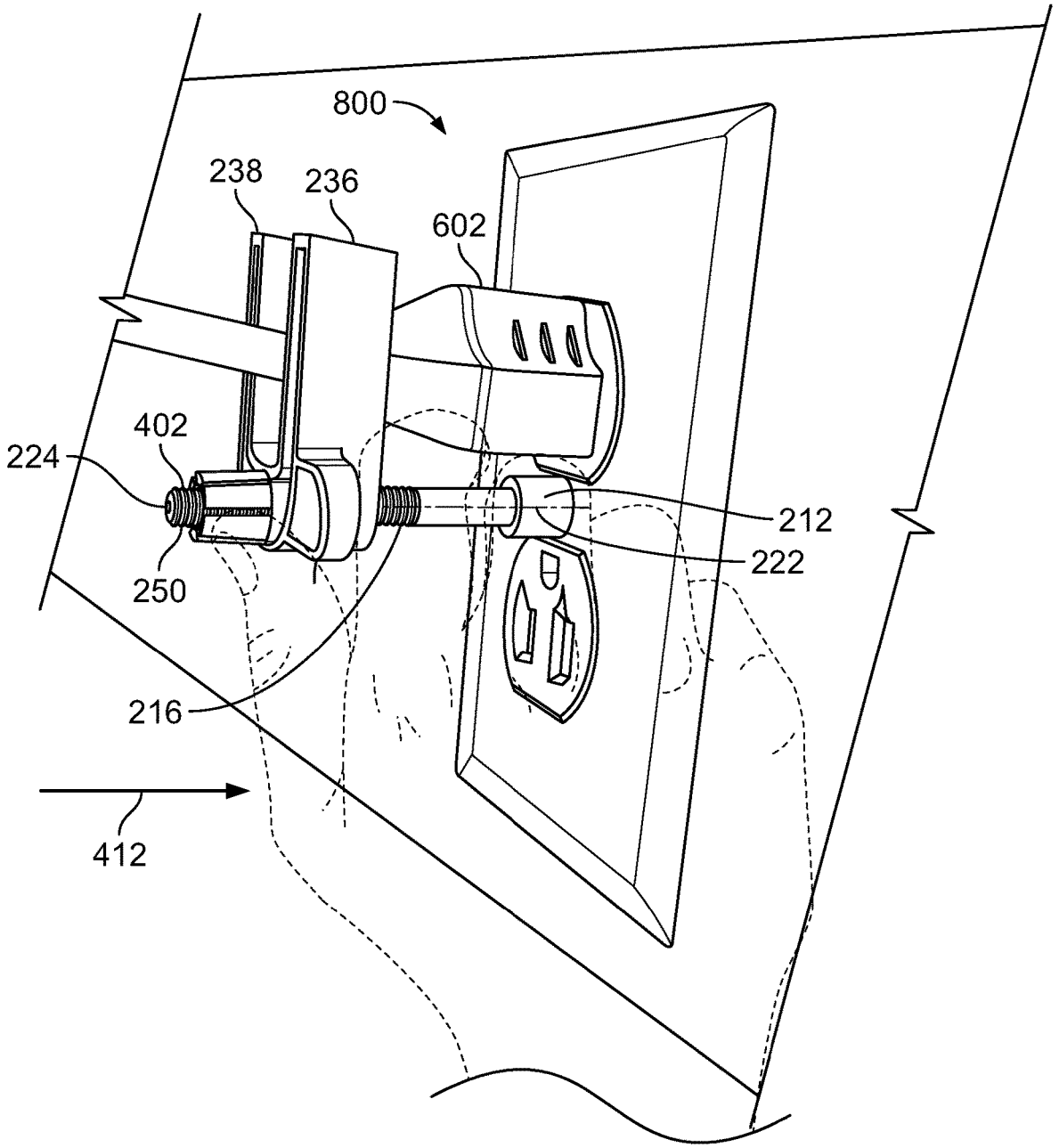

FIG. 8 illustrates the plug retainer 214 at an intermediate position 800 relative to the post 212. Specifically, the plug retainer 214 moves or slides along the retainer-receiving portion 216 of the post 212 in the first direction 412 until at least one of the first arm 236 or the second arm 238 of the plug retainer 214 engage (e.g., directly engage or contact) the power plug 602. As the plug retainer 214 moves along the retainer-receiving portion 216 of the post 212, the retaining tabs 248 move radially (e.g., outwardly and inwardly) relative to the longitudinal axis 222 of the post 212 along the outer surface 402 and the grooves 250 of the retainer-receiving portion 216.

FIG. 9 illustrates the example retainer apparatus 200 in a retaining position 900 (e.g., a locking or securing position). Referring to FIG. 9, in the retaining position 900, the plug retainer 214 of the illustrated example is positioned to lock or secure the power plug 602 to the first outlet 206*a* of the dual electrical outlet 202. To secure the power plug 602 to the dual electrical outlet 202, the plug retainer 214 is positioned relative to the post 212 such that the first plug engaging surfaces 242 of the first arm 236 and the second arm 238 engage (e.g., directly contact) the power plug 602. Additionally, the retainer apparatus 200 (e.g., the plug retainer 214 and the post 212) of the illustrated example does not interfere with the second outlet 206*b* of the dual electrical outlet 202 when the retainer apparatus 200 is in the retaining position 900 securing the power plug 602 to the first outlet 206*a* of the dual electrical outlet 202. Further, as illustrated in FIG. 9, the first arm 236 and the second arm 238 of the plug retainer 214 do not overlap a perimeter or dimensional envelope 904 of the second outlet 206*b* such that a second power cord can be inserted into and/or removed from the second outlet 206*b* without interference from the retainer apparatus 200.

FIG. 10 illustrates another view of the example retainer apparatus 200 in the retaining position 900. In the illustrated example, the second plug engaging surfaces 244 of the plug retainer 214 engage (e.g., help retain) the power plug 602. A cord 1002 of the power plug 602 passes through the gap 246 defined between the first arm 236 and the second arm 238.

Referring to FIGS. 9 and 10, the retainer apparatus 200 of the illustrated example restricts or deters removal of the power plug 602 from the first outlet 206*a* of the dual electrical outlet 202 when the retainer apparatus 200 is in the retaining position 900 because more effort (e.g., more force) is needed than simply pulling the power plug 602 from the first outlet 206*a*. In particular, a significantly more amount of force and/or effort is needed to remove the power plug 602 from the first outlet 206*a* than would be required to remove the power plug 602 in the absence of the retainer apparatus 200.

To remove the power plug 602 from the first outlet 206*a* of the dual electrical outlet 202 when retained by the retainer apparatus 200, a user can grasp the plug retainer 214 and pull the plug retainer relative to the post 212 along the retainer-receiving portion 216 of the post 212 in the second direction 414 (e.g., away from the dual electrical outlet 202) until the post-receiving portion 218 (e.g., the post-receiving opening 424) of the plug retainer 214 disengages or detaches from the post 212. For example, a user can grasp the grip 252 and/or other portions of the plug retainer 214 to pull the plug retainer 214 away from the post 212. Specifically, a user can remove the plug retainer 214 from the post 212 without use of a tool. Thus, in emergency situations, a user, using only his or her hands, can remove the plug retainer 214 from the post 212 and unplug or remove the power plug 602 from the dual electrical outlet 202.

FIG. 11 illustrates example retainer apparatus 200 disclosed herein coupled to another example electrical outlet 1102 (e.g., a four-socket, or quad, electrical outlet 1102). The quad electrical outlet 1102 of the illustrated example includes a cover plate 1104 having a plurality of wall plate cover screw openings 1106. In the illustrated example, each of the wall plate cover screw openings 1106 can receive or support the retainer apparatus 200 disclosed herein. For example, each of the wall plate cover screw openings 1106 of the example quad electrical outlet 1102 may receive the post 212 of the example retainer apparatus 200 disclosed herein.

Figure 12:
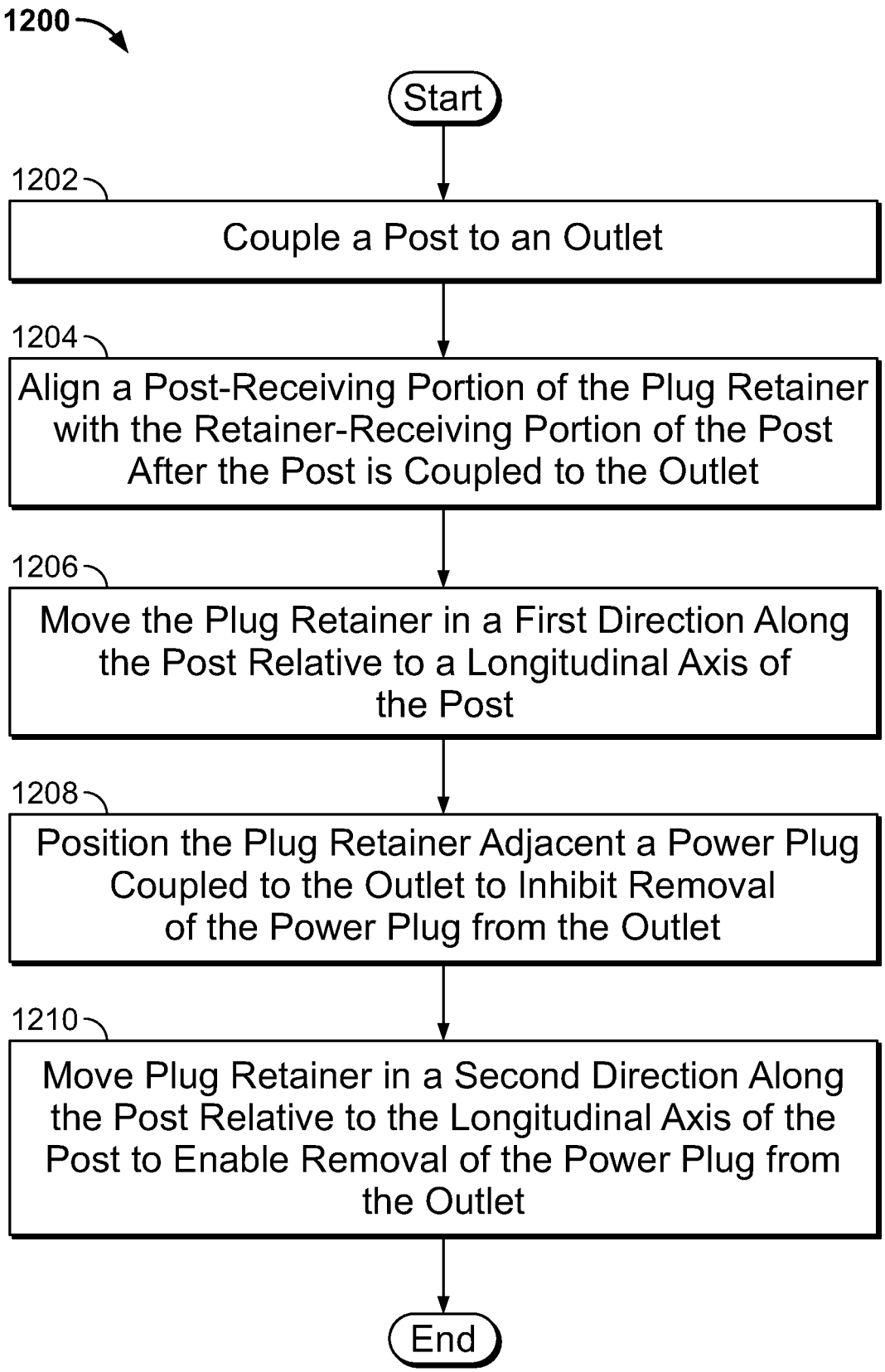
FIG. 12 is a flowchart of an example method of securing an example electrical plug using an example retainer apparatus disclosed herein.

FIG. 12 is a flowchart of an example method 1200 of coupling an example retainer apparatus disclosed herein to an electrical outlet. Although the example method 1200 is described with reference to the flowcharts illustrated in FIG. 12, many other methods of using the example retainer apparatus 200 disclosed herein may alternatively be used. For example, the order of execution of the blocks may be changed, and/or some of the blocks described may be changed, eliminated, or combined.

Referring to FIG. 12, the method 1200 begins by coupling the post 212 of the example retainer apparatus 200 to the dual electrical outlet 202 (block 1202). For example, the wall plate cover screw 208 may be removed from the wall plate cover 204 of the dual electrical outlet 202, and the post 212 of the retainer apparatus 200 may be coupled to the wall plate cover screw opening 210 via the fastener 234 of the post 212. In some examples, the wall plate cover screw 208 may be stored in the boss 254 of the plug retainer 214.

After the post 212 is coupled to the dual electrical outlet 202, the post-receiving portion 218 (e.g., the post-receiving opening 424) of the plug retainer 214 is aligned with retainer-receiving portion 216 of the post 212 (block 1204).

The plug retainer 214 (e.g., via the post-receiving portion 218) is then moved or slid in the first direction 412 along the retainer-receiving portion 216 of the post 212 relative to the longitudinal axis 222 of the post 212 (block 1206). More specifically, the plug retainer 214 is positioned adjacent the power plug 602 coupled to the dual electrical outlet 202 to inhibit removal of the power plug 602 from the dual electrical outlet 202 (block 1208). For example, the plug retainer 214 is moved along the post 212 until the first plug engaging surfaces 242 directly contact or engage the power plug 602.

To remove the power plug 602 from the dual electrical outlet 202, the plug retainer 214 is moved (e.g., pulled) in the second direction 414 (e.g., away from the dual electrical outlet 202) along the post 212 relative to the longitudinal axis 222 (block 1210). For example, the plug retainer 214 can be moved or slid in the second direction 414 opposite the first direction 412 relative to the retainer-receiving portion 216 of the post 212 to at least one of disengage the plug retainer 214 from the power plug 602 or remove the plug retainer 214 from the retainer-receiving portion 216 of the post 212. The plug retainer 214 can be removed from the post 212 with a user's hand and without use of a tool.

At least some of the aforementioned examples include one or more features and/or benefits including, but not limited to, the following:

In some examples, a retainer apparatus includes a post having a first end attachable to a wall plate cover opening of an outlet and a second end opposite the first end. In some such examples, a plug retainer to be removably coupled to the post, the plug retainer to move relative to the post between the first end of the post and the second end of the post.

In some examples, the first end of the post includes a fastener.

In some examples, wherein the fastener protrudes from the second end of the post.

In some examples, the fastener is a threaded fastener and the wall plate cover opening is a threaded opening.

In some examples, the post includes a plurality of grooves positioned along at least a portion of the post between the second end of the post and an intermediate portion of the post, the intermediate portion being between the first end of the post and the second end of the post.

In some examples, the plug retainer includes a first arm and a second arm protruding from a base, the first arm and the second arm defining a gap therebetween.

In some examples, the plug retainer further includes a plurality of flexible tabs protruding from the base, the plurality of flexible tabs and an aperture of the base defining a post-receiving opening to receive the post.

In some examples, the plug retainer includes a grip protruding from at least one of the first arm or the second arm in a direction non-parallel relative to a longitudinal axis of the at least one of the first arm or the second arm, the grip to facilitate removal of the plug retainer from the post.

In some examples, the plug retainer includes a boss protruding from at least one of the first arm or the second arm in a direction non-parallel relative to a longitudinal axis of the at least one of the first arm or the second arm, the boss to receive a wall plate cover screw of the outlet.

In some examples, a retainer apparatus includes a post having a first portion to couple to wall plate cover opening of an outlet and a second portion defining a retainer-receiving portion. In some such examples, the retainer apparatus includes a plug retainer to be removably coupled to the post. In some such examples, the plug retainer to slide in a first direction relative to the retainer-receiving portion of the post to engage a power plug of an electrical device coupled to the outlet. In some such examples, the plug retainer slides in a second direction opposite the first direction relative to the retainer-receiving portion of the post to at least one of disengage the plug retainer from the power plug or remove the plug retainer from the retainer-receiving portion of the post.

In some examples, the retainer-receiving portion includes a plurality of grooves spaced along a longitudinal length of the post defining the retainer-receiving portion of the post.

In some examples, the plug retainer includes flexible tabs that are to engage one of the grooves to maintain a position of the plug retainer relative to the post.

In some examples, respective ones of the flexible tabs include a protrusion that is to engage the grooves.

In some examples, the flexible tabs protrude from a base of the plug retainer, the flexible tabs having longitudinal axes that are canted relative to a longitudinal axis of the post.

In some examples, the plug retainer includes a first arm and a second arm protruding from a base of the plug retainer, the first arm being spaced from the arm to define a gap therebetween, at least one of the first arm or the second arm to engage the power plug to retain the power plug coupled to the outlet.

In some examples, a method includes coupling a post of a retainer apparatus to a wall plate cover opening of an outlet; aligning a post-receiving opening of a plug retainer of the retainer apparatus relative to the post after the post is coupled to the outlet; moving the plug retainer in a first direction along the post relative to a longitudinal axis of the post; and positioning the plug retainer adjacent an electrical plug coupled to the outlet to inhibit removal of the plug from the outlet.

In some examples, the method includes removing a plate cover screw from the wall plate cover opening prior to attaching the post to the wall plate cover opening of the outlet.

In some examples, the method includes moving the plug retainer in a second direction along the post relative to the longitudinal axis of the post to enable removal of the electric plug from the outlet.

In some examples, the method includes moving the plug retainer in the first direction or the second direction along the post is performed without use of a tool.

In some examples, the method includes moving the plug retainer in the second direction includes disengaging the plug retainer from the post, and disengaging the plug retainer from the post is to be caused by a pulling force in the second direction without use of a tool.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A retainer comprising:

a post having a first end to be received by an opening of a wall plate cover of an outlet and a second end opposite the first end, at least a portion of the post having a plurality of grooves positioned between the first end and the second end, the plurality of grooves forming a retainer-receiving portion; and a plug retainer to be removably coupled to the post, the plug retainer to move relative to the post between the first end of the post and the second end of the post, the plug retainer including a plurality of flexible tabs protruding from a base of the plug retainer in a direction along a longitudinal length of the post, the flexible tabs to slide relative to the plurality of grooves and over an outermost surface of the retainer-receiving portion of the post when the plug retainer is moved relative to the retainer-receiving portion of the post.

2. The retainer of claim 1, wherein the first end of the post includes a fastener.

3. The retainer of claim 2, wherein the fastener protrudes from the second end of the post.

4. The retainer of claim 2, wherein the fastener is a threaded fastener and the opening of the wall plate cover is a threaded opening.

5. The retainer of claim 1, wherein the at least the portion of the post is located between the second end of the post and an intermediate portion of the post, the intermediate portion being between the first end of the post and the second end of the post.

6. The retainer of claim 1, wherein the plug retainer includes a first arm and a second arm protruding from the base, the first arm and the second arm defining a gap therebetween.

7. The retainer of claim 6, wherein the plurality of flexible tabs and an aperture of the base define a post-receiving opening to receive the post.

8. The retainer of claim 1, wherein the flexible tabs protrude from the base in a direction parallel to the longitudinal length of the post.

9. The retainer of claim 1, wherein the plug retainer and the post are configured to enable the plug retainer to be removably coupled to the post while the post is coupled to the wall plate cover.

10. The retainer of claim 1, wherein the flexible tabs are structured to deflect relative to the post when the plug retainer moves relative to the post.

11. The retainer of claim 1, wherein the plurality of grooves forms a non-threaded retainer-receiving portion.

12. The retainer of claim 1, wherein the flexible tabs protrude from the base along a longitudinal axis of the post-receiving opening, the flexible tabs to deflect radially relative to the longitudinal axis as the flexible tabs move along the outermost surface of the post defined by the grooves.

13. The retainer of claim 12, wherein the flexible tabs include protrusions that project from respective ones of the flexible tabs in a direction toward the longitudinal axis, the protrusions to cause the respective ones of the flexible tabs to deflect radially outward relative to the longitudinal axis when the protrusions engage the outermost surface of the retainer-receiving portion of the post, the flexible tabs to deflect toward the longitudinal axis when the respective ones of the protrusions are positioned in a respective one of the grooves.

14. A retainer comprising:

a post having a first end to couple to an opening of a wall plate cover of an outlet and a second end opposite the first end; and a plug retainer to be removably coupled to the post, the plug retainer to move relative to the post between the first end of the post and the second end of the post, the plug retainer including a first arm and a second arm protruding from a base, the first arm and the second arm defining a gap therebetween, the plug retainer including a grip protruding from at least one of the first arm or the second arm in a direction non-parallel relative to a longitudinal axis of the at least one of the first arm or the second arm, the grip to facilitate removal of the plug retainer from the post.

15. A retainer comprising:

a post having a first end to be received by an opening of a wall plate cover of an outlet and a second end opposite the first end; and a plug retainer to be removably coupled to the post, the plug retainer to move relative to the post between the first end of the post and the second end of the post, the plug retainer including a first arm and a second arm protruding from a base, the first arm and the second arm defining a gap therebetween, the plug retainer including a boss protruding from at least one of the first arm or the second arm in a direction non-parallel relative to a longitudinal axis of the at least one of the first arm or the second arm, the boss to receive a wall plate cover screw.

16. A retainer comprising:

a post having a first portion to couple to an opening of a wall plate cover of an outlet and a second portion defining a retainer-receiving portion, the retainer-receiving portion including a plurality of discrete grooves;

a plug retainer to be removably coupled to the post, the plug retainer to slide in a first direction relative to the retainer-receiving portion of the post to engage a power plug of an electrical device coupled to the outlet, the plug retainer to slide in a second direction opposite the first direction relative to the retainer-receiving portion of the post to at least one of disengage the plug retainer from the power plug or remove the plug retainer from the retainer-receiving portion of the post; and a lock to removably couple the plug retainer to the post, the lock being movable in a direction radially outwardly relative to a longitudinal axis of the post to enable the lock to slide relative to the post in at least one of the first direction or the second direction in response to the plug retainer being moved relative to the post.

17. The retainer of claim 16, wherein the retainer-receiving portion includes a plurality of grooves spaced along a longitudinal length of the post defining the retainer-receiving portion of the post.

18. The retainer of claim 17, wherein the lock is integrally formed with the plug retainer, the lock including flexible tabs that are to engage one of the grooves to maintain a position of the plug retainer relative to the post.

19. The retainer of claim 16, wherein the plug retainer includes a first arm and a second arm protruding from a base of the plug retainer, the first arm being spaced from the second arm to define a gap therebetween, at least one of the first arm or the second arm to engage the power plug to retain the power plug coupled to the outlet.

20. A retainer comprising:

a post having a first portion to be received by an opening of a wall plate cover of an outlet and a second portion defining a retainer-receiving portion, the retainer-receiving portion including a plurality of discrete grooves spaced along a longitudinal length of the post defining the retainer-receiving portion of the post; and a plug retainer to be removably coupled to the post, the plug retainer to slide in a first direction relative to the retainer-receiving portion of the post to engage a power plug of an electrical device coupled to the outlet, the plug retainer to slide in a second direction opposite the first direction relative to the retainer-receiving portion of the post to at least one of disengage the plug retainer from the power plug or remove the plug retainer from the retainer-receiving portion of the post, the plug retainer including flexible tabs to engage one of the discrete grooves to maintain a position of the plug retainer relative to the post, and respective ones of the flexible tabs including a protrusion to engage the discrete grooves.

21. The retainer of claim 20, wherein the flexible tabs are to slide relative to the post in response to the plug retainer being moved relative to the post.

22. The retainer of claim 20, wherein the plug retainer is configured to be removably coupled to the post while the post is coupled to the wall plate cover.

23. A retainer comprising:

a post having a first portion to be received by an opening of a wall plate cover of an outlet and a second portion defining a retainer-receiving portion, the retainer-receiving portion including a plurality of isolated grooves spaced along a longitudinal length of the post defining the retainer-receiving portion of the post; and a plug retainer to be removably coupled to the post, the plug retainer to slide in a first direction relative to the retainer-receiving portion of the post to engage a power plug of an electrical device coupled to the outlet, the plug retainer to slide in a second direction opposite the first direction relative to the retainer-receiving portion of the post to at least one of disengage the plug retainer from the power plug or remove the plug retainer from the retainer-receiving portion of the post, the plug retainer including flexible tabs that are to engage one of the isolated grooves to maintain a position of the plug retainer relative to the post, and the flexible tabs to protrude from a base of the plug retainer and flex radially outwardly over an outermost surface of the retainer-receiving portion of the post when the plug retainer slides along the post relative to the isolated grooves, the flexible tabs having longitudinal axes that are canted relative to a longitudinal axis of the post.

24. The retainer of claim 23, wherein the flexible tabs are to slide relative to the post when the plug retainer is moved relative to the post.

25. A method comprising:

coupling a post of a retainer to an opening of a wall plate cover of an outlet;

aligning a post-receiving opening of a plug retainer of the retainer relative to the post after the post is coupled to the outlet;

moving the plug retainer in a first direction along the post relative to a longitudinal axis of the post while the post is coupled to the wall plate cover, the plug retainer including a lock to slide relative to the longitudinal axis of the post when the plug retainer moves in the first direction;

sliding the lock of the plug retainer along a retainer-receiving portion of the post defined by a plurality of discrete grooves formed on an outer surface of the post; and positioning the plug retainer adjacent an electrical plug coupled to the outlet to inhibit removal of an electrical plug from the outlet, the positioning of the plug retainer adjacent the electrical plug causing the lock of the plug retainer to engage the post.

26. The method of claim 25, further including removing a plate cover screw from the opening of the wall plate cover prior to attaching the post to the opening of the wall plate cover.

27. The method of claim 25, further including moving the plug retainer in a second direction along the post relative to the longitudinal axis of the post to enable removal of the electrical plug from the outlet.

28. The method of claim 27, wherein the moving of the plug retainer in the first direction or the second direction along the post is performed without use of a tool.

29. The method of claim 27, wherein the moving of the plug retainer in the second direction includes disengaging the plug retainer from the post, wherein the disengaging of the plug retainer from the post is caused by a pulling force in the second direction without use of a tool.

* * * * *